US005139253A

United States Patent [19]

Bohme et al.

[11] Patent Number: 5,139,253

[45] Date of Patent: Aug. 18, 1992

[54] SUCTION TABLE FOR CONVEYING PRINTED SHEETS

[75] Inventors: Andreas Bohme, Bensheim; Peter Mayer, Valentine Gensheimer, both of Muhlheim/Main; Hanns-Otto Haas, Heusenstamm; Hans Schwerdter, Obertshausen; Bert Cappel, Muhlheim/Main, all of Fed. Rep. of Germany

[73] Assignee: MAN Roland Druckmaschinen AG, Fed. Rep. of Germany

[21] Appl. No.: 690,084

[22] Filed: Apr. 23, 1991

[30] Foreign Application Priority Data

Apr. 24, 1990 [DE] Fed. Rep. of Germany ..... 4012948

[51] Int. Cl.[5] ..... B65H 29/16

[52] U.S. Cl. ..... 271/197; 271/94

[58] Field of Search ..... 271/196, 197, 94–96

[56] References Cited

U.S. PATENT DOCUMENTS 3,321,121 5/1967 Nyberg ..... 271/197 X
3,889,801 6/1975 Boyer ..... 271/197 X
4,384,782 5/1983 Acquaviva ..... 271/197 X
4,651,984 3/1987 Emrich ..... 271/197 X

FOREIGN PATENT DOCUMENTS 1033225 7/1958 Fed. Rep. of Germany .
3838078 8/1989 Fed. Rep. of Germany .

*Primary Examiner*—Richard A. Schacher
*Attorney, Agent, or Firm*—Leydig, Voit & Mayer

[57] ABSTRACT

A conveying cable for conveying sheets includes a suction chamber with a supporting surface defining a shallow groove having a plurality of suction openings therein over which a perforated suction belt moves. A plurality of vent openings separately communicating with atmosphere are disposed adjacent the belt edges to prevent the sheets from being sucked against the table surface. The perforations in the suction belt preferably take the form of staggered slots which leave imperforate zones free along the center and adjacent the edges of the belt to help reduce undesirable belt stretching and the suction openings in the supporting surface increase in size adjacent the delivery end of the table.

11 Claims, 4 Drawing Sheets

SUCTION TABLE FOR CONVEYING PRINTED SHEETS

FIELD OF THE INVENTION

The present invention relates generally to sheet conveying devices and more particularly concerns a suction table for conveying printed sheets to a printing press unit.

BACKGROUND OF THE INVENTION

Belt or conveying tables are typically used to convey printed sheets to a printing press. To enable a close sequence of sheets to be achieved at high speeds, the printed sheets are usually conveyed in overlapping relationship on such tables by conveyor belts. It has been found very advantageous to operate the conveying table by suction. Unfortunately, the facilities previously utilized for this purpose have many disadvantages.

For example, DE-OS 3,838,078 discloses a device for conveying an overlapping stream of sheets wherein the conveying table is in the form of a suction box to which an axial flow fan is connected and perforate suction belts are guided over orifices in the conveying table. When the fan operates, the interior of the table is exhausted and paper sheets moving over the table are sucked onto the suction belts and conveyed onwards thereby. In special instances, the arrangement includes an additional suction chamber at the delivery end of the table, with separate controllability, and the arrangement of the suction belts in guide grooves below the plane of the table, so that the surface of the suction belts is substantially at the height of the plane of the table.

The foregoing system operates generally satisfactorily and reliably for ordinary papers, but problems arise with special papers, more particularly, relatively thin paper stocks. First, the suction belts elongate in operation in the course of time so that an undefined slip occurs between the suction belts and the drive rollers. Such slip can, of course, be countered by take-up devices but the drive ratios cease to be equal and constant in time on both sides of the table. Second, the suction belts do not always lie completely flat on the table or in the guide grooves, so that a relatively large air gap arises along the belt edges. This is unavoidable partly because of the suction belt edges curling up and partly because of surface irregularities in the belt and supporting groove. Consequently, air is sucked in laterally through and adjacent the suction belts and the negative pressure is propagated over large areas of the conveying table. As a result, the paper stock is sucked around the suction belt edges and then grazes against the table severely, often causing late or skewed sheets in the lays. Also, due to edge-curling, the sheets no longer lie flat when they arrive at the lays.

Further problems arise in the case of intermittent drive such as occurs, for example, when the printed sheets entering the lays are retarded cyclically, for example, by the drive of the conveying or suction belts varying in speed periodically at the cadence of the sheets. Since it is precisely in the transition zone between the table and the lays that the sheets are retained on the suction belts only by way of a reduced suction area, it becomes impossible to control sheet position sufficiently at the time of maximum decelerations. The prior art attempts to solve this problem by using an additional suction chamber to exert in the front zone of the table a greater negative pressure on the sheets than in the rear zone. In this arrangement, however, the suction must be timed and the table becomes more complex since it has been found in practice that a separate blower may be necessary to produce the negative pressure in the additional suction chamber. This increased negative pressure is very unsatisfactory particularly in the case of relatively thin papers because of the risk of papers being sucked through with the result of impairment of sheet alignment. Consequently, for both relatively thin papers and relatively thick boards the use of a large number of auxiliary facilities such as pressing rollers, braking brushes, ball riders, elaborate suction air regulation systems or the like are employed to ensure that the sheets are guided on the table with some reliability.

SUMMARY AND OBJECTS OF THE INVENTION

It is therefore the primary aim of the present invention to ensure that the printed sheets are conveyed very flat over the table in conveying conditions which are uniform width-wise and over the whole of the length, with constant conditions being maintained for prolonged periods of operation. It is another object to ensure that the sheets are advanced to the press in proper register notwithstanding all forms of stretch, slip and suction. A still further object is to ensure that sheets of every format and of every stock quality can be conveyed satisfactorily without additional facilities.

In carrying out the invention a conveying table for conveying sheets includes a suction chamber with a supporting surface defining a shallow groove having a plurality of suction openings therein over which a perforated suction belt moves. A plurality of vent openings separately communicating with atmosphere are disposed adjacent the belt edges to prevent the sheets from being sucked against the table surface. The perforations in the suction belt preferably take the form of staggered slots which leave imperforate zones free along the center and adjacent the edges of the belt to help reduce undesirable belt stretching and the suction openings in the supporting surface increase in size adjacent the delivery end of the table.

Pursuant to the invention, a very important factor is that unwanted air, including lateral suction acting on the sheet being conveyed, can be compensated for by the venting orifices according to the invention which are disposed laterally of the conveyor belts. The sheets are therefore retained uniformly and can be guided continuously over the conveying table without distorting. Further means ensure that the belts cannot stretch excessively, thus ensuring defined slip conditions for the belt drive. Also, the effective suction area in all phase positions of the drive is constant and even in the front edge zone of the table, where there are fewer overlapping sheets, is such that the sheet is always subject to equal and adequate suction retaining forces.

In the preferred embodiment, the perforate arrangement of the suction belt is formed so that support zones in the perforated belt remain imperforate at least at the edge and at the center of the belt, thus ensuring that uncontrolled slip due to stretch between the drive rollers and the belts does not arise because of unmonitored belt stretch. Also, the suction openings in the table are adapted to the force actually required in the direction of sheet conveyance. To this end, relatively large suction openings are present in the front edge of the table. This ensures that the sheet can still be retained reliably in the front part of the table as it is conveyed to the printing unit.

The arrangement of venting orifices in the belt guide groove, but laterally and separately from suction orifices, provides a further basic improvement. Belt wear decreases, tensile forces acting on the belts are reduced, and so belt stretch can be minimized and rendered more uniform.

Sheet control can be improved by the provision of two suction chambers disposed consecutively in the direction of sheet movement, an additional suction belt being provided at the discharge end to increase retention there. Alternatively, the suction belts can take the form of toothed belts, thus improving retention and providing completely defined stretch-to-slip ratios.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
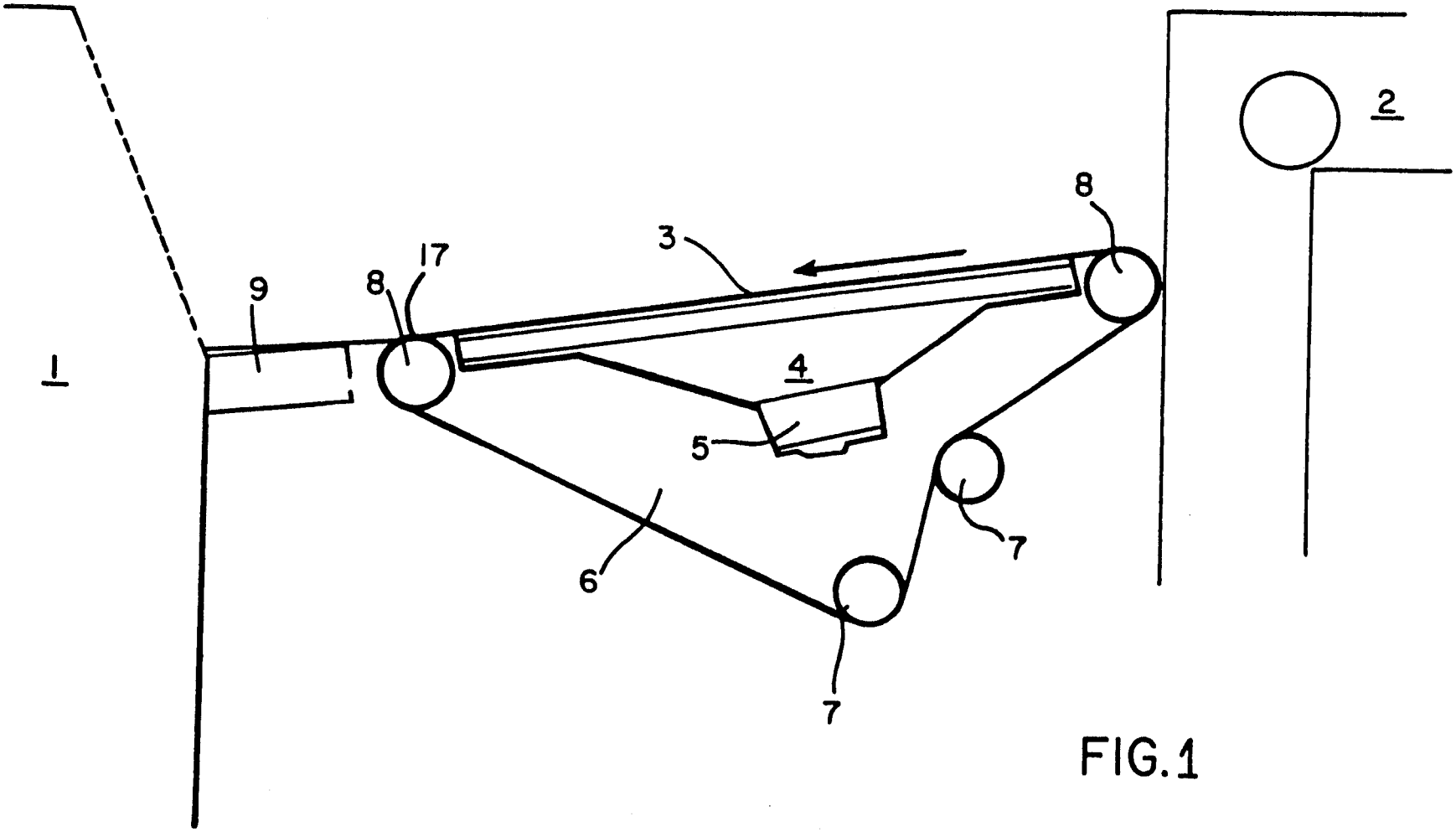
FIG. 1 is a schematic side elevation of a conveying table according to the present invention disposed between a sheet feeder and a printing press unit.

Turning now to the drawings, a conveying table 3 is schematically illustrated in FIG. 1 disposed between a printing press 1 and a sheet feeder 2. The conveying table 3 has a suction chamber 4 to whose underside an axial-flow fan 5 is connected. The suction chamber 4 and suction fan 5 provide a common storage chamber in which a negative pressure builds up. One or more perforate suction belts 6 are disposed to move over the table 3. The belts 6 run around tensioning rollers 7 on the underside of the table 3 and around driving or guide shafts 8 at the table ends. In the illustrated embodiment, the table 3 is continuously perforated near the guide for the belts 6 so that an airflow from the top of the table 3 can be produced by the suction chamber 4 and fan 5 over the whole length of the table 3.

The printed sheets are conveyed from the sheet feeder 2 in overlapping form—i.e., the sheet end which is the rear end as considered in the direction of sheet movement is disposed above the front end of the immediately following sheet. Thus, the front part of any sheet is underneath and is retained on the table 3 by the belts 6 for conveyance to the press, where each sheet first disengages from the table 3 and is then aligned by way of its front edge and side edge and transferred to the press 1.

Figure 2:
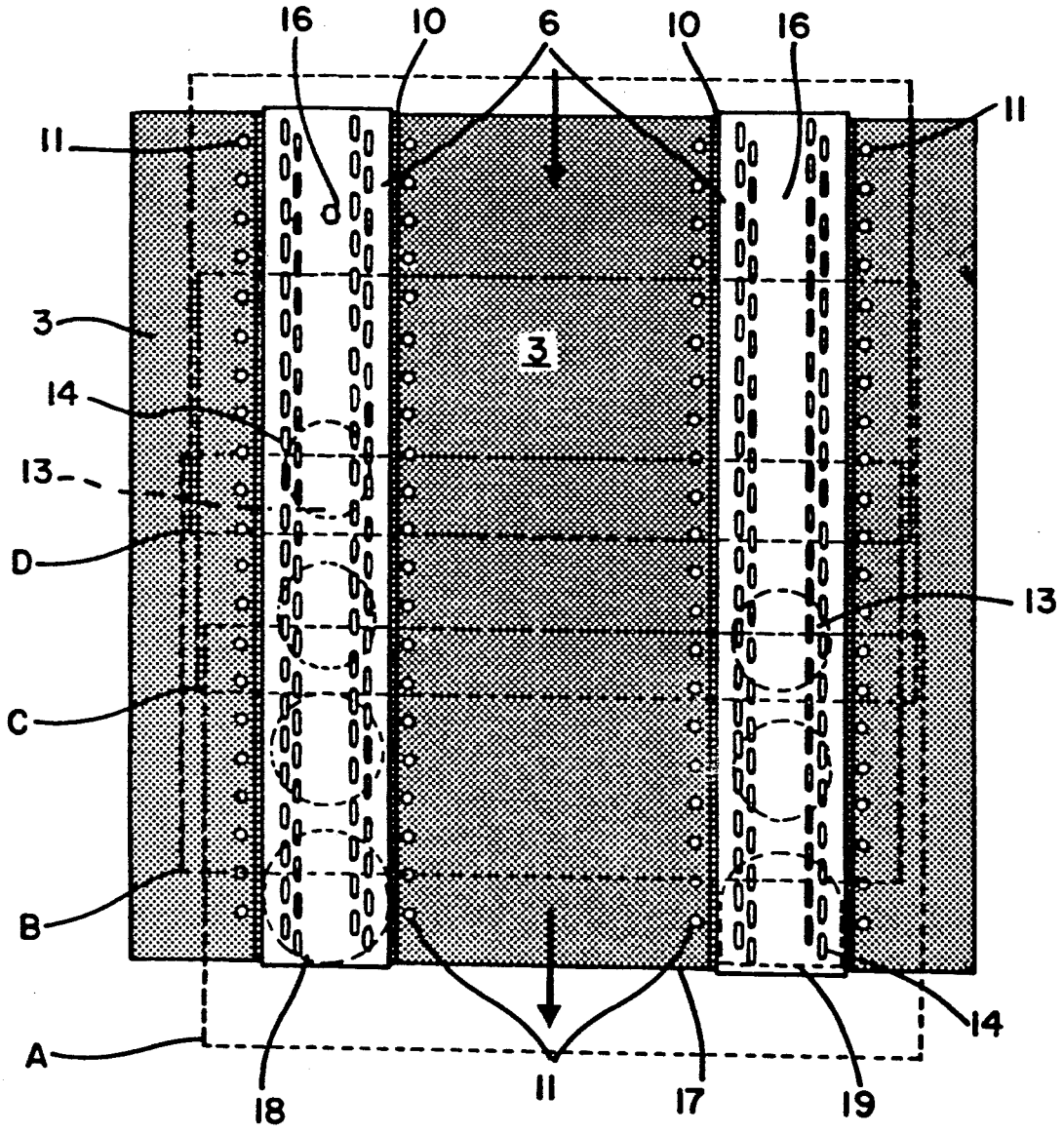
FIG. 2 is a plan view of the conveying table according to the invention.

Referring to FIG. 2 a plan view of the table 3 is shown. The belts 6 are led in guide grooves 10 and are formed with uniformly distributed suction orifices 14 disposed over the whole length of the belts 6. The table 3 is formed laterally of the grooves 10 with venting orifices 11 communicating with atmosphere, and so the negative pressure produced by the fan 5 cannot be effective near the orifices 11. When "unwanted" air arises, for example, because the belts 6 are not lying completely flat, the suction or negative pressure acting on the sheet being conveyed is reduced near the orifices 11 Also, in the preferred embodiment, a number of venting orifices 12 are provided in the guide grooves 10 in the edge zone of the belts 6 in order to reduce stressing thereof, thus ensuring that the belts 6 are not sucked so strongly into contact with the base of the grooves 10. In this embodiment, the venting orifices 11 adjacent and outboard of the sides of the belts 6 may be eliminated.

Figure 3:
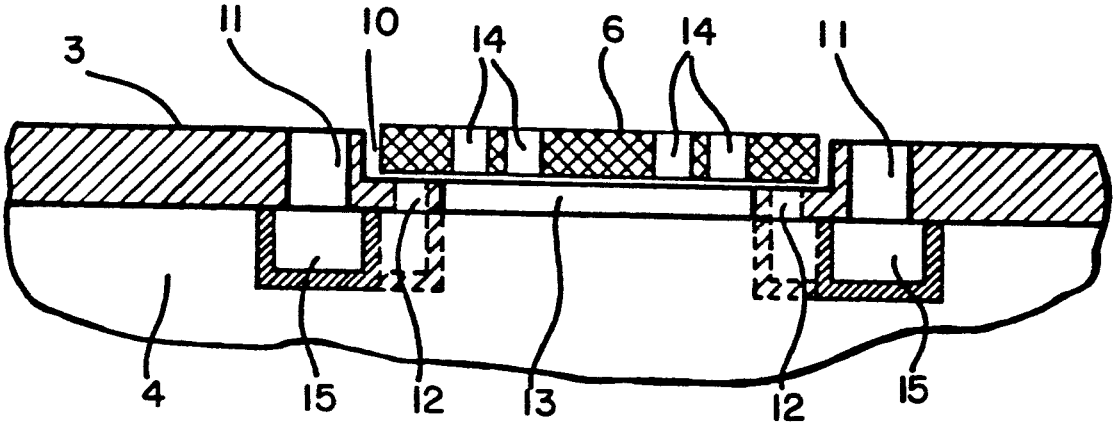
FIG. 3 is an enlarged, fragmentary cross-section through a part of the conveying table according to the invention.

In FIG. 3 an enlarged, fragmentary cross-section through the table 3 near one of the belts 6 is shown. The belt 6 is disposed in the groove 10 so as to project by about 0.2 mm above the surface of the table 3. The groove 10 communicates through suction openings 13 with the suction chamber 4, the openings 13 each underlying a plurality of the orifices 14 in the belts 6. The venting orifices 11 extend through the table 3 laterally of the guide groove 10. On the underside of the table 3 the orifices 11 are combined by means of venting ducts 15 and are therefore isolated from the suction chamber 4. The ducts 15 are connected to atmosphere—i.e., they are not at a negative pressure. Consequently, should a suction be produced by a laterally non-sealing belt 6, the negative pressure in the lateral zone is compensated for by the orifices 11. To enhance the foregoing effect, the belt 6 projects slightly above the table surface so that the communication between the groove 10 and the venting orifices 11 remains open even when a sheet is present. Alternatively, or additionally, further venting orifices 12 can be provided in the guide groove 10, the orifices 12 then being disposed below the imperforate lateral zones of the belts 6 and also being connected to the ducts 15 so that operation of the table 3 is not impaired.

Both of the foregoing steps obviate unwanted air, which occurs either below the edge of the belt 6 or because of waviness in the surface thereof and which leads, in both cases, to the printed sheet being sucked fast to the table.

However, this still does not completely solve the problems of irregular distortion of the belts 6 by operational stressing. As a further step to solve problems in sheet conveyance due to different distortions of the belt 6, a variation in the arrangement and/or shape of the orifices 14 is provided. The important consideration is that the perforations are not continuous over the complete width of the belts 6 and at least at the belt center 16 an imperforate strip is left so that belt strength is increased in this zone. The belt 6 is therefore divided into support zones at the edge and at the belt center 16 and suction zones with the orifices 14 symmetrically, thus ensuring that the belt 6 does not stretch excessively in this zone and curl up after prolonged operation or experience any sort of ratio-impairing severe elongation so that the driving forces are not fully transmitted from the shafts 8. Also, instead of circular orifices 14, slots can be provided which, when the suction openings 13 in the table 3 are passed over, ensure a continuous air passage or intake cross-section, thus ensuring that the suction surfaces of each belt 6 do not differ from one another in dependence upon their operative state. The slot-like orifices 14 are disposed, for example, on both sides of the belt center 16 in two or more staggered rows. An imperforate strip helping to reduce elongation in each belt 6 is present between the latter rows.

It will also be understood that in practicing the invention and in particular regard to the arrangement of venting orifices 11, 12, it might be advantageous for suction ducts to be disposed below the belt guides instead of the complete table 3 being a suction box. In this case, however, the storage volume of the chamber 4 is reduced considerably. An arrangement of this kind may be advantageously employed as a special construction for particular cases, for example, in small-format presses or for board printing. A simplifying consideration is that the orifices 11 and 12 need not then be combined in venting ducts since they can discharge directly to atmosphere.

The problems of different suction cross-sections in the conveyance of printed sheets over the table 3 are very important in connection with cyclic speed changes in the drive of the belts 6. Such driving conditions are required, for example, to retard the printed sheets before they are aligned by way of their front and side edges.

In FIG. 2, four printed sheets A, B, C and D are shown in dash lines as a flow of overlapping sheets advancing over the table 3 in the direction indicated by arrows. The first sheet A extends into the aligning zone. The suction openings 13 are also shown in dash lines under the belts 6. The respective leading sheet A or B or C is retained on the belts 6 only in the region of its front edge as far as the front edge of the immediately following sheet B, C or D respectively. Since at its delivery end 17 near the press 1 the first sheet A has already partly left the table 3, it is being retained only in the relatively short zone between the end 17 and the next sheet B, the same already partly covering suction openings !8, 19 at the delivery end 17 and therefore reducing the forces available for retention of the first sheet A.

In accordance with another feature of the invention and to maintain the suction forces at a level sufficient, for example, to retard the sheet A by means of the belts 6, suction openings 18 and 19 are provided which are larger than the ordinary suction openings !3. The cross-sectional shape can also be varied to suit the force required. The opening 18, for example, is of circular cross-section with a 30% suction area gain. As an alternative, the opening 19 is shown in the form of a semicircle merging into a rectangle, giving an area gain of 50% over the ordinary suction opening 13. Another variation is for the rectangular zone of the opening 19 to be trapezoidal, leading to a further gain in area in the direction of sheet movement The retaining forces between the belt 6 and the sheet therefore build up much more slowly than when all the suction openings are of the same size although the engagement surface decreases during the departure of the sheets from the table. However, the sheets further up are retained on the table 3 only with precisely the force necessary, thus substantially obviating the risk of distortion and of irregular conveyance. In other respects, of course, the openings 18 and 19 are in practice used as required and are the same for all the belts 6.

Figure 4:
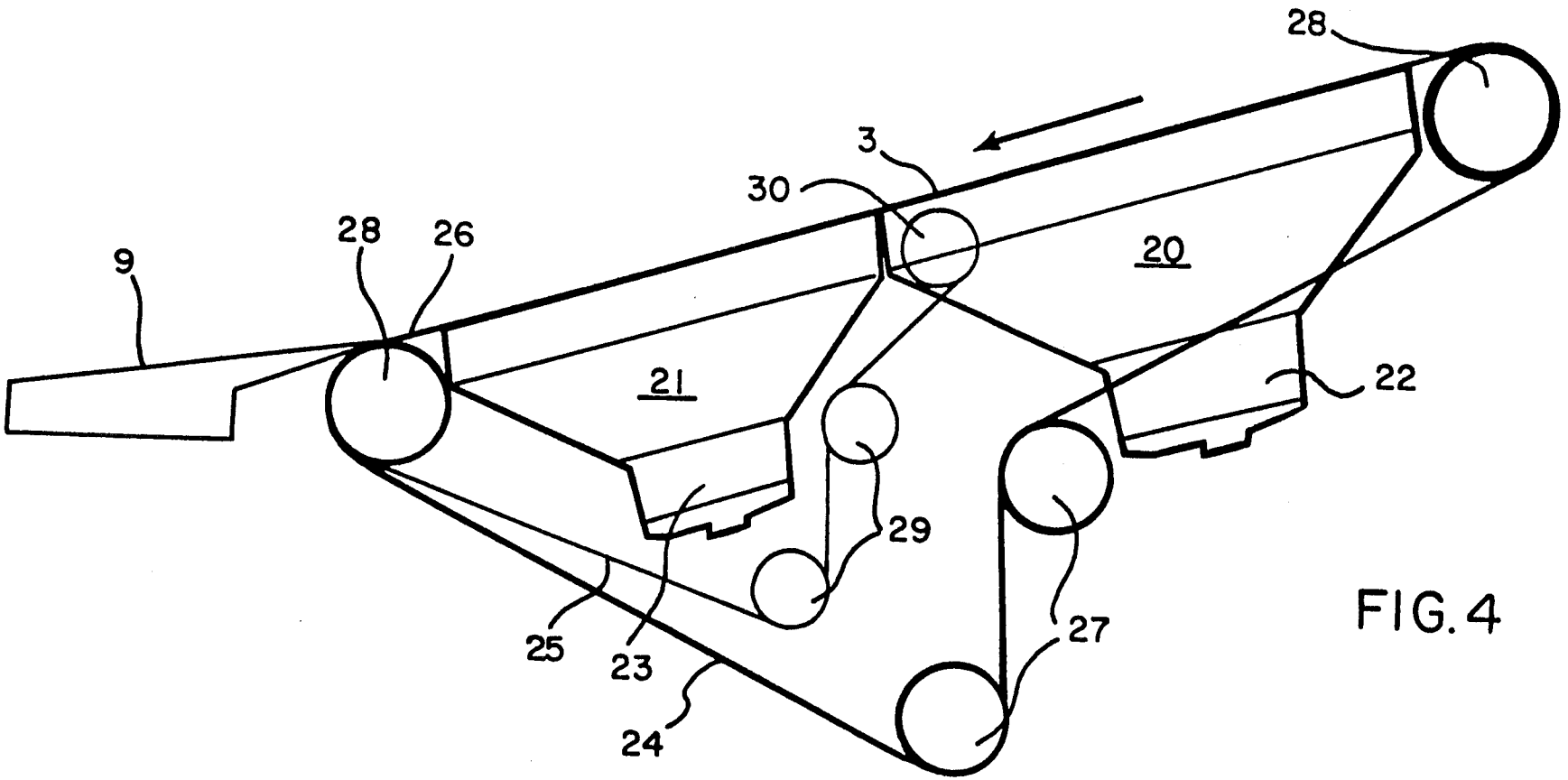
FIG. 4 is a schematic side elevation, similar to FIG. 1, showing a modified embodiment of a conveying table in which two suction chambers are disposed lengthwise thereof.

The features of the invention set out above help to obviate distortion and an irregular feed of the printed sheets. However, further steps may be necessary for relatively high speeds. FIG. 4 shows a modified embodiment of the conveying table 3 having two suction chambers 20 and 2 disposed consecutively in the direction of sheet movement. Axial flow fans 22 and 23 are associated with each suction chamber 20 and 21, respectively. The two chambers can be controlled separately to control the suction air. Suction belts 24 extend around the two chambers 20 and, 21 and run around guide or drive shafts 28 and tensioning rollers 27. The table 3 is as previously formed with the required suction openings. This modified arrangement enables different retaining forces to be produced over the length of the table by the use of different negative pressures.

A further feature of this modified embodiment of the invention provides, at the delivery end 26 near the press 1, further suction belts 25 that run around the suction box 21 of the table 3 and run over additional tensioning rollers 29 and guide shafts 30. If desired, this arrangement can be arranged with the additional suction belt 25 disposed centrally between the two other suction belts 24. Of course, the necessary suction openings 13 in the table 3 are also associated with the belt 25. Increased retaining forces can therefore be provided near the chamber 21 since the retaining area over the whole length of the chamber 21 is increased by 50%. Guidance of the sheets is therefore less dependent upon stretching of the various belts 24, 25. In this case, too, enlarged suction openings can of course be present at the delivery end 26 of the table 3.

Figure 5:
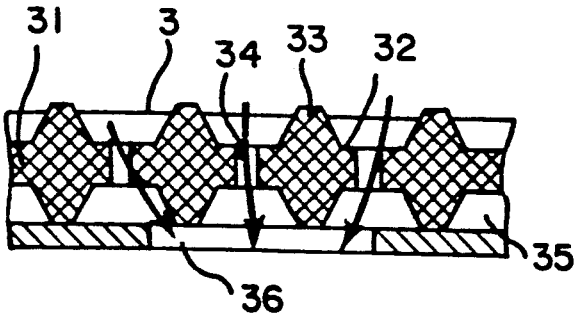
FIG. 5 is an enlarged, fragmentary cross-section through a modified embodiment of a suction belt in the form of a toothed belt.

In accordance with a still further feature of the invention, the problems of belt stretch and of the resulting slip in the belt drive can be further reduced at slight extra cost. FIG. 5 is an enlarged, fragmentary section through a special suction belt in the form of a belt 31 having teeth on both sides. A belt of this kind requires companion guide and drive shafts 28, for example, in the form of splined shafts. In this case no slip can occur between the shaft 28 and the toothed belt 31. The stretch thereof due to the drive forces remains but cannot cause relative movement and, therefore, inaccuracies in the conveyance of the sheets. A guide groove 35 which is deeper than the guide groove of the flat suction belts 6, 24, 25 is necessary for guiding the air through the belt 31 since the tooth spaces must be very effectively sealed laterally. A suction orifice 34 is present in each tooth root or base 32 between teeth 33 of the belt 31 and communicates with suction orifices 36 in the table 3; the negative pressure acts through the orifices 34 in the spaces of the toothed belt 31 and in that zone retains the sheet in surface engagement with the teeth 33. However, it is precisely here that action is needed to prevent the negative pressure from becoming effective over the table 3. To this end, the venting orifices 12 can very advantageously be disposed laterally of the suction belt guide in the surface of the table 3. The negative pressure which is bound to spread because of poor sealing of the tooth spaces is thus decreased a very short lateral distance below the sheet edge.

In the case of the modified embodiment shown in FIG. 5, venting orifices cannot be present in the guide groove 35, for if they were, there would be a virtual short-circuit in the suction system. However, a high negative pressure is necessary for the system having the toothed belt 31 since the passage cross-sections for air suction which are available are not so large. This system should therefore be reserved for high-performance uses in which high accelerations and speeds are required.

We claim as our invention:

1. A conveying table for conveying printed sheets to a printing press unit, said table comprising, in combination, at least one suction chamber having a support surface defining a plurality of suction openings, a suction fan communicating with said suction chamber for creating a partial vacuum therein, at least one perforated suction belt formed with imperforate edges, said suction belt being rotatable around said suction chamber and over said support surface and said suction openings, with said imperforate edges being disposed outboard of said suction openings, and means defining a plurality of vent orifices in said support surface of said suctions table disposed parallel to said suction belt for communicating with atmosphere separately from said suction chamber and said suction openings, at least some of said vent orifices being disposed outboard of said imperforate edges of said suction belt and at least some of said vent orifices being disposed beneath said imperforate edges of said suction belt.

2. A table according to claim 1 wherein said vent orifices are arranged substantially in one or more rows along said suction belt, and duct means are disposed under said supporting surface for communicating with said vent orifices.

3. A table according to claim 2 wherein said suction chamber defines suction duct means for providing communication between said suction openings in said supporting surface and said suction fan, and said duct means for said vent orifices communicates with atmosphere.

4. A table according to claim 1 including a shallow groove in said supporting surface for guiding said suction belt, said groove having a depth less than the thickness of said suction belt.

5. A table according to claim 1 wherein said suction belt is formed with a plurality of suction orifices disposed to overlie said suction openings defined in said support surface, said suction orifices being formed in said suction belt to define longitudinally extending imperforate zones at least along the belt center and adjacent the belt edges.

6. A table according to claim 5 wherein said suction orifices in said suction belts are formed as a plurality of longitudinally extending rows of slots, said slots in one of said rows being offset longitudinally with respect to said slots in an adjacent row.

7. A table according to any of claims 1, 2, 4, 3, 5, 6 wherein said support surface defines a delivery end adjacent said printing press unit in the direction of sheet travel and the cross-sectional area of said suction openings adjacent said delivery end is greater than the cross-sectional area of said suction openings upstream of said delivery end.

8. A table according to claim 7 wherein said suction openings adjacent said delivery end have a cross-sectional area at least 30% greater than the cross sectional area of said upstream suction openings.

9. A table according to claim 7 wherein said upstream suction openings are generally circular in shape and said suction openings adjacent said delivery end are enlarged at least adjacent the forward edges thereof.

10. A table according to any of claims 1, 2, 4, 3, 5, 6 wherein said table comprises two separate suction chambers each having a supporting surface defining suction openings and a separate controllable suction fan communicating therewith, and said suction belt being rotatable around said two suction chambers and over said respective supporting surfaces thereof.

11. A table according to claim 10 including at least one additional suction belt guided around the downstream one of said two suction chambers and in synchronism with said other suction belt.

* * * * *